United States Patent [19]

Gauthier et al.

[11] 4,161,768

[45] Jul. 17, 1979

[54] ARTIFICIAL CHRISTMAS TREE

[76] Inventors: Ray J. Gauthier, 2931 Lloyd Georg St.; Fred G. Caverzan, 3415 Mark Ave., both of Windsor, Ont., Canada, N9E 2X3

[21] Appl. No.: 915,576

[22] Filed: Jun. 14, 1978

[51] Int. Cl.[2] ..... A47G 33/06

[52] U.S. Cl. ..... 362/123; 362/806; 428/8; 428/20

[58] Field of Search ..... 428/18–21, 428/8; D11/118; 156/61; 211/196–205; 362/123, 806

[56] References Cited

U.S. PATENT DOCUMENTS

| | | | |
|---|---|---|---|
| Re. 24,074 | 10/1955 | Buchanan | 174/74 A X |
| 1,555,621 | 9/1925 | Barker | 428/20 |
| 2,080,523 | 5/1937 | Williams et al. | 428/18 |
| 2,726,324 | 12/1955 | Shapiro | 428/19 X |
| 3,206,593 | 9/1965 | Winnicki, Sr. | 428/18 X |
| 3,463,696 | 8/1969 | Baus et al. | 428/18 |
| 3,504,169 | 3/1970 | Freeburger | 362/806 X |
| 3,962,554 | 6/1976 | Eigel | 174/74 A |
| 4,093,758 | 6/1978 | Weskamp et al. | 428/20 X |

*Primary Examiner*—Henry F. Epstein
*Attorney, Agent, or Firm*—Chas. Krassov

[57] ABSTRACT

This invention is an electrically lit artificial Christmas tree which is assembled from separate components consisting of a central stalk, a base which supports said stalk, and main branches which have secondary branches attached to them. The branches which are made of two stiff, intertwisted and insulated electrical wires are attached to the central stalk by inserting their ends into holes provided in the stalk; this also connects the branches electrically to electrical conductors provided within the stalk; which are in turn powered by an electric cord leading from the conductors in the stalk to an electrical wall outlet. The branches have Christmas tree decorative electric globes attached to them, and are trimmed with artificial pine needles.

2 Claims, 4 Drawing Figures

ARTIFICIAL CHRISTMAS TREE

This invention relates generally to electrically lit artificial Christmas trees, and particularly to such trees which are purchased in knock-down form for assembly by the purchaser.

In the manufacture of electrically lit artificial Christmas trees, several important factors must be considered. In the first place, the tree must be made in knock-down form to facilitate packaging and reduce the size of the package; secondly, the components must be designed for easy assembly by people with no technical training or ability; and thirdly, and perhaps even more important, is to make the tree secure against electrical shock and fire hazard.

Figure 2:
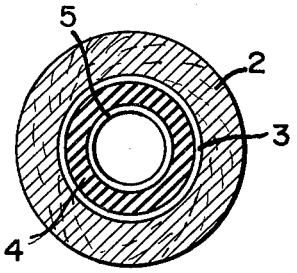
Figure 3:
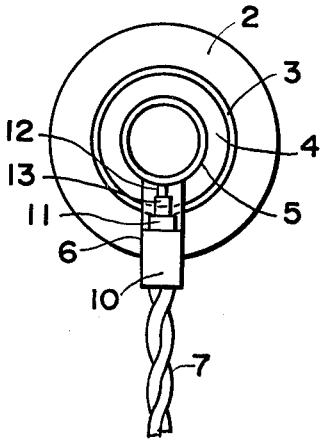
Figure 4:
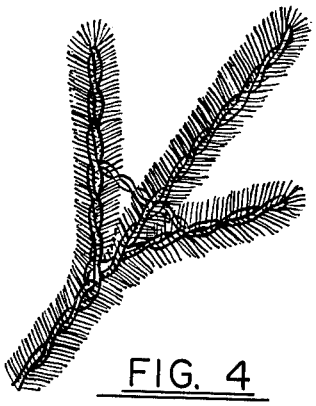
Figure 1:
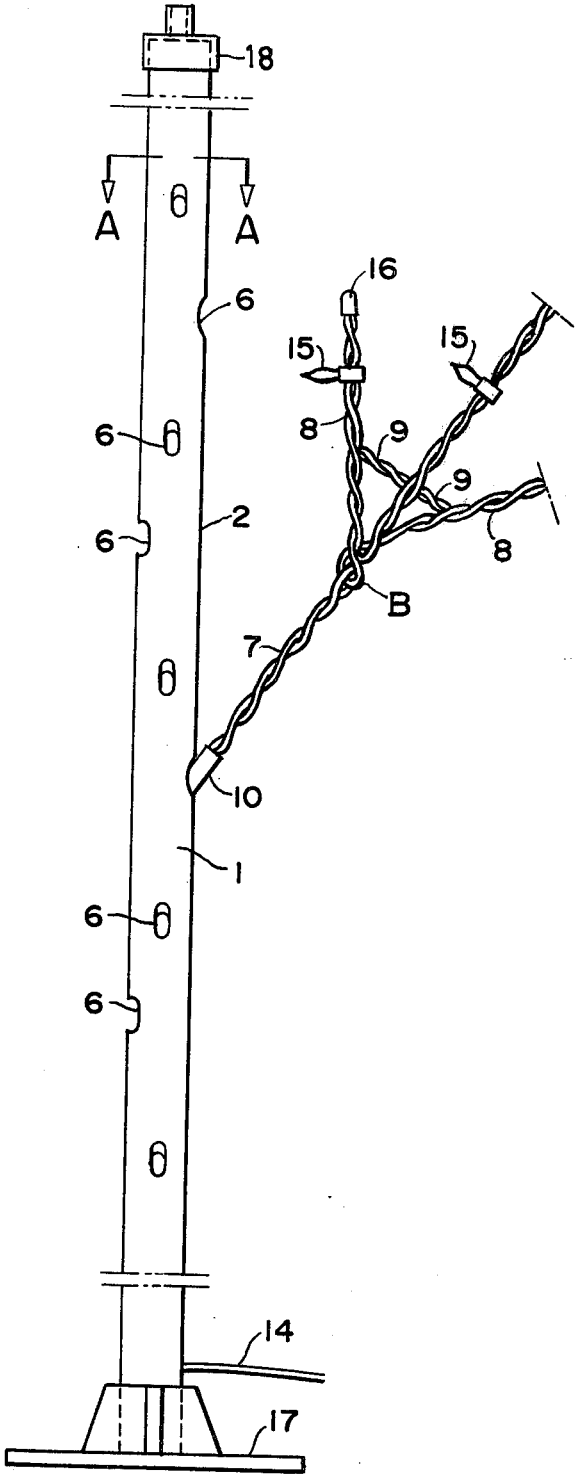

This invention was designed with the above mentioned factors in mind as will be seen from the following description and drawings, in which, FIG. 1, is an elevation of the invention, FIG. 2, is section A—A of FIG. 1, FIG. 3, is a diagram showing the electrical contacts, and FIG. 4, shows the appearance of a finished branch.

The Christmas tree, as shown in the drawings, consists of a central stalk 1, which is supported by and sits upon a standard type of pedestal 17. The stalk 1, consists of an outer wooden tube 2, which can be painted any required color, or provided with a surface relief to resemble bark. Within the wooden tube 2, are two concentric copper tubes 3 and 5, which are separated from each other by a tube 4 which is of an insulating material. All the tubes 2, 3, 4, and 5, are held tightly against each other, they run the full length of the stalk, and are capped on the top by a fixed cap 18.

The stalk 1, is drilled with a plurality of spaced holes 6, which are located around the said stalk 1, in locations where natural branches of a tree would join the stalk. The holes 6 are the means by which the branches 7 are connected to the stalk 1. These holes are drilled at a downward angle towards the center of the stalk in order to have the branches 7 extending from the said stalk at an upward and outward angle. The main branches 7, are provided with secondary branches 8,8.

The branches 7 and 8 are made of two twisted together stiff, and insulated electrical wires. The secondary branches 8 are attached to the main branches 7 by tightly wrapping them around the said main branches as shown at "B" in FIG. 1. Clusters of imitation pine needles, usually made of some plastic material are held by the intertwined electrical wires of the said branches, as shown in FIG. 4. Each of the branches is also provided with small electrically lit bulbs 15, the sockets of which make electrical contact with the wires which constitute the branches; and the tip of each branch 7 is provided with a plug 10 which makes electrical contact with the tubes 3 and 5 in the stalk 1, when the branch is inserted into a hole 6. Power is provided to the secondary branches by jump wires 9, which connect them to the main branch.

The plug 10 at the end of each of the branches 7, consists of short tubular container which fits snugly into the holes 6. Within this container are two contact points 11 and 12 which are insulated from said container. They are also insulated from each other by insulation 13. The point 11 makes contact with the conductor tube 3, while the point 12 contacts conductor tube 5; as shown in FIG. 3. A standard electric cord 14 is connected to the conductor tubes 3, and 5, at the bottom of the stalk 1, and is plugged into the nearest wall outlet, for power. A fixed cap 18 is provided for the top of the stalk 11 to prevent accidental contact with the interior of stalk 1 when it is connected to a power source caps 16 are provided to the ends of branches 7 and 8.

The cap 18 which covers the top end of the central stalk 1 is provided for safety purposes. This cap is provided with a short tube which extends upwardly from the center of said cap for the purpose of attaching thereto a star or any other christmas type of ornament.

The assembly of the tree from its knock-down components, is a very simple one since it consists of merely inserting the central stalk 1, into the base 17, and inserting the branches into the holes 6.

Having described our invention, what we claim is:

1. An artificial Christmas tree which is produced in knock-down components for assembly by the user, comprising in combination a central stalk made of a wooden tube containing therein electrical conductors which are concentric with and run the full length of said central stalk; spaced holes located around the stalk for inserting therein branches of said tree, said holes leading from the surface of the stalk in a downward angle to its center; a plurality of main branches to which are attached secondary branches, made of two intertwined, stiff, and insulated electrical wires, said secondary branches being electrically connected to their main branch by jump wires, and each of the main branches terminating at its top with a cap, and at its stalk insertion end with a plug which makes electrical contact with the said electrical conductors within the stalk; tufts of artifical pine needles covering the said main and secondary branches; spaced, colored, ornamental electric lights attached to said main and secondary branches; a cap on the top of the central stalk provided with a central extension for attaching an ornament thereto; in combination with an electric cord leading from the said conductors within the central stalk and at the bottom thereof for attaching the tree to a power source; and a pedestal to which the central stalk can be attached.

2. A Christmas tree such as described in claim 1, in which the conductors within the central stalk consist of an outer concentric copper tube and an inner concentric copper tube, separated from each other by a tubular insulating material located between the said tubes; and the said plug at the stalk insertion end of each main branch consisting of two concentric electrical contacts, insulated from each other, the outer contact being shorter in order to contact the said outer conductor, and the inner contact extending further to contact the inner conductor, when the said main branch is inserted into the central stalk.

* * * * *